United States Patent [19]

Evenson

[11] 4,337,017

[45] Jun. 29, 1982

[54] HYDRAULIC SLEEVE VALVE AND SEAL ARRANGEMENT FOR PISTON PUMP

[76] Inventor: William R. Evenson, 11618 Sagehollow, Houston, Tex. 77089

[21] Appl. No.: 213,022

[22] Filed: Dec. 4, 1980

Related U.S. Application Data

[63] Continuation-in-part of Ser. No. 79,305, Sep. 26, 1979, abandoned.

[51] Int. Cl.[3] ..... F04B 7/00

[52] U.S. Cl. ..... 417/516; 417/900

[58] Field of Search ..... 417/516, 517, 900

[56] References Cited

U.S. PATENT DOCUMENTS

| | | | |
|---|---|---|---|
| 2,168,658 | 8/1939 | Thomas | 91/499 |
| 3,989,420 | 11/1976 | Taylor | 417/517 |
| 4,178,142 | 12/1979 | Schwing | 417/516 |
| 4,198,193 | 4/1980 | Westerlund | 417/517 |

*Primary Examiner*—William L. Freeh
*Attorney, Agent, or Firm*—B. P. Fishburne, Jr.

[57] ABSTRACT

To prevent leakage of wet concrete passing from a reciprocating pump to a delivery conduit and to prevent clogging of the seal and valve means interposed between the pump outlets and the mouth of the delivery conduit, a floating sleeve is biased by pump system hydraulic pressure into solid engagement with the wear ring which in turn is held in firm sliding contact and sealed engagement with an opposing wear plate at the outlets of the pump structure. The floating sleeve is pressure sealed on opposite sides of a delivery port for pressurized hydraulic fluid to positively exclude concrete from fouling the operation of the sleeve. Concrete grout under pressure entering a void behind the sleeve applies additional pressure to the sleeve to bias the wear ring even in the event of hydraulic pressure loss. The grout within the void prevents the sleeve from ever backing away from the wear ring.

9 Claims, 5 Drawing Figures

HYDRAULIC SLEEVE VALVE AND SEAL ARRANGEMENT FOR PISTON PUMP

CROSS-REFERENCE TO RELATED APPLICATION

This application is a continuation-in-part of prior copending application Ser. No. 79,305, filed Sept. 26, 1979, now abandoned, for HYDRAULIC CONE VALVE AND SEAL ARRANGEMENT FOR PISTON PUMP.

BACKGROUND OF THE INVENTION

The present invention relates to improvements in the type of concrete pumping apparatus disclosed in U.S. Pat. No. 4,198,193 to Westerlund et al. More particularly, the present invention seeks to provide a more effective and reliable means for biasing a wear ring on the oscillating valve assembly into firm sliding engagement at all times with the opposing wear plate of the hopper at the pump outlets. The invention also seeks to provide a better means of preventing the floating sleeve which biases the wear plate from becoming bound up or fouled by concrete which would eventually defeat the purpose and operation of the floating sleeve and also bind up the pump.

Additionally, the present invention seeks to utilize the pressure of the wet concrete on the floating sleeve to bias it in conjunction with or independently of hydraulic fluid pressure in the pump system so that failure of hydraulic pressure will not completely destroy the ability of the floating sleeve to hold the wear ring against the opposing wear plate.

The invention seeks further to improve and simplify the field serviceability of an apparatus of the general kind shown in the Westerlund patent.

Other features and advantages of the invention will become apparent during the course of the following detailed description.

DETAILED DESCRIPTION

Figure 1:
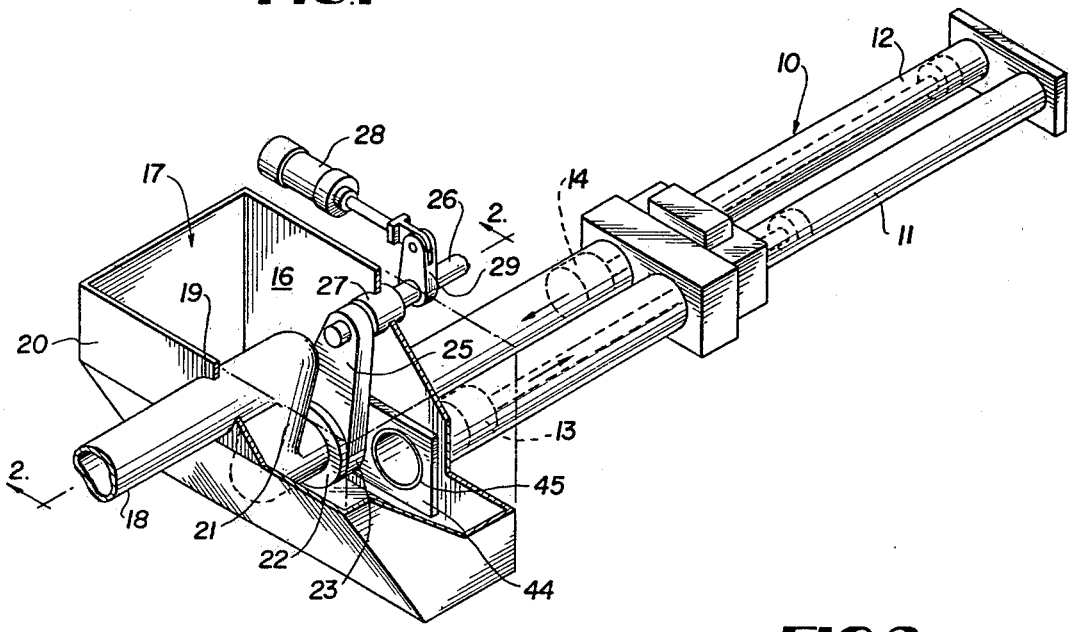
FIG. 1 is a perspective view, partly in section, of a piston pump for concrete or the like with which the present invention is employed.

Referring to the drawings in detail wherein like numerals designate like parts, the numeral 10 designates a piston pump for concrete or other flowables including a pair of parallel pump cylinders 11 and 12 and cyclically driven pump pistons 13 and 14 contained therein. The pump is generally conventional and therefore need not be described in great detail. It is operated by hydraulic fluid pressure including conventional controls and pressure regulator means, not shown. The pump pistons 13 and 14 move oppositely during the pumping cycle, as shown by the directional arrows in FIG. 1.

The discharge ends of the two cylinders 11 and 12 are fixed within openings 15 in the back wall 16 of a concrete hopper 17. A transmission conduit 18 for the concrete extends through an opening 19 in the hopper front wall 20. Within the hopper, an elbow portion 21 has an end flange 22 fixed to a housing 23 containing a floating sleeve valve element 24, to be further described. The housing 23 has an attached crank arm 25 coupled to a drive shaft 26 supported in a bearing 27 on the hopper wall 16. A shaft and crank arm are oscillated by any suitable means such as a power cylinder 28 and connected driving crank 29 attached to the shaft 26.

Figure 2:
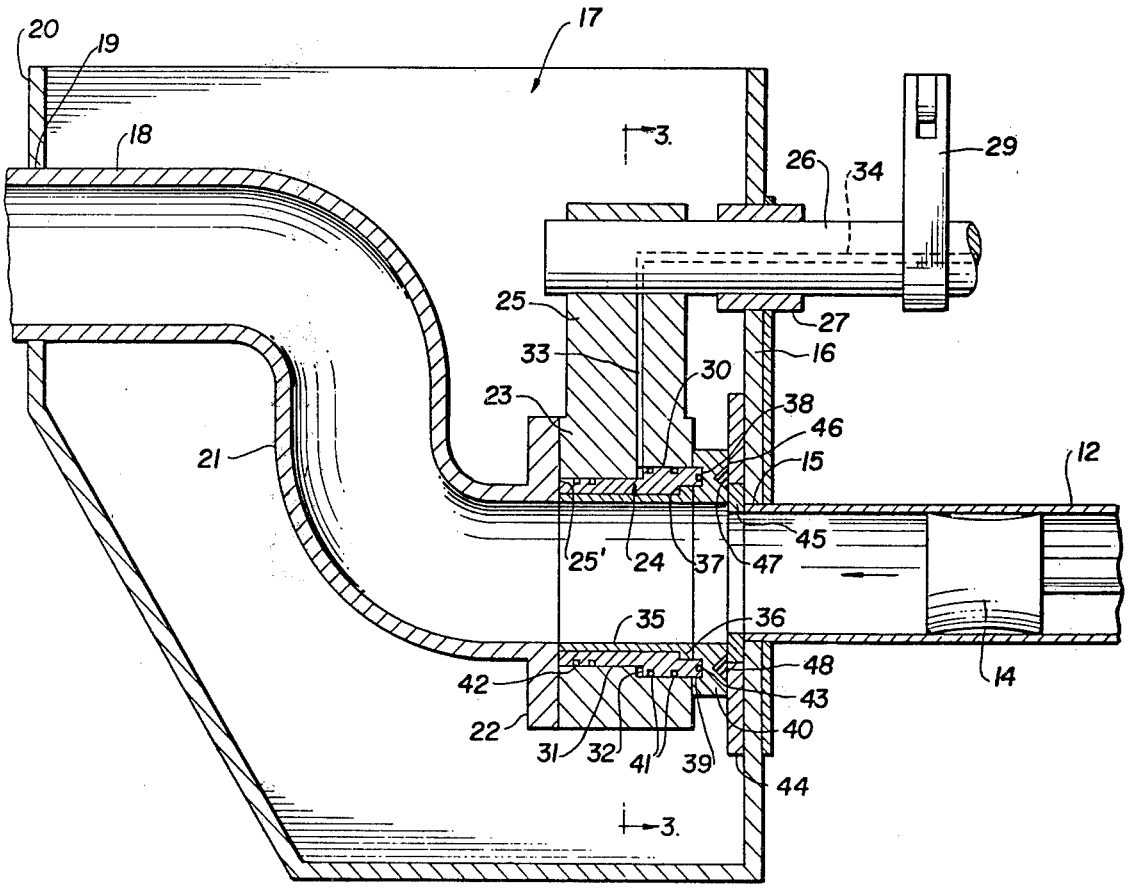
FIG. 2 is an enlarged fragmentary vertical section taken on line 2—2 of FIG. 1 and showing the hydraulic sleeve valve, wear ring, wear plate and associated elements forming the subject matter of this invention.
Figure 3:
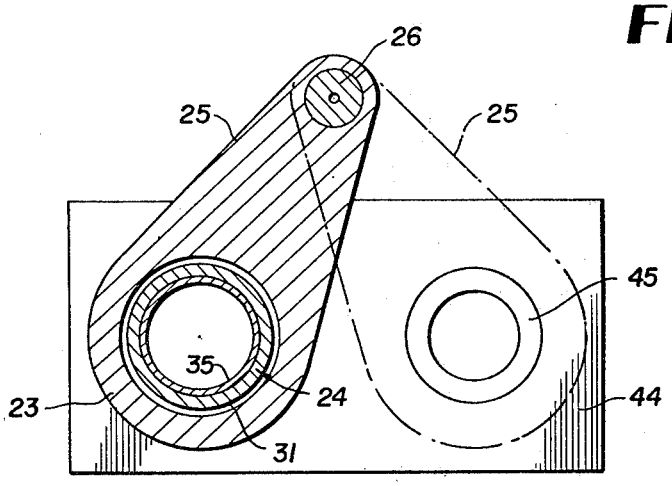
FIG. 3 is a transverse vertical section taken on line 3—3 of FIG. 2.
Figure 4:
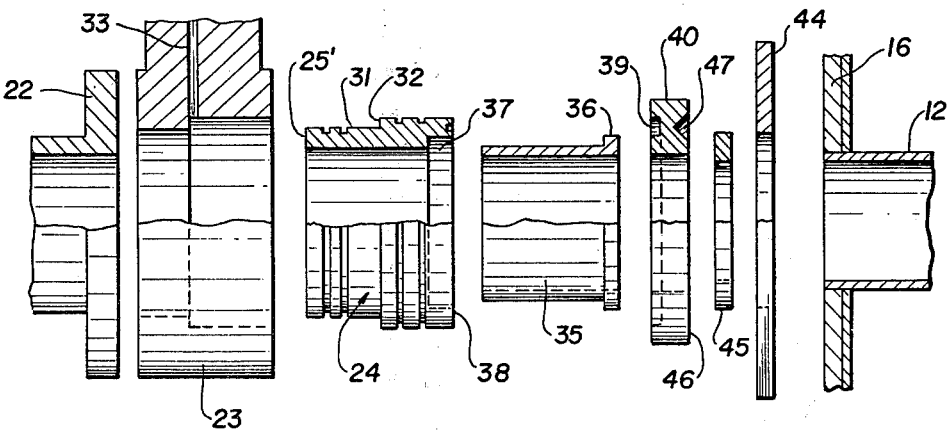
FIG. 4 is an exploded side elevation, partly in cross section, showing the principal elements of the invention.

In the operation of the pump, the hydraulically driven pistons 13 and 14 alternately draw wet concrete from the hopper 17 and then alternately pump this concrete through the transmission conduit 18 while the mouth of the latter is being held in registry with the discharge end of one pump cylinder at a time. FIGS. 1 and 2 show the conduit 18 in registry with the bore of cylinder 12 while the piston 14 of that cylinder is driving concrete into the transmission conduit. Simultaneously, the piston 13 of cylinder 11 is drawing concrete from the hopper 17 into the cylinder 11 while the bore of this cylinder is out of registration with the conduit 18.

The previously-noted sleeve valve element 24 is annular and fits into a bore 30 of housing 23 with its rear end face 25' initially contacting the flange 22, FIG. 2. The sleeve valve element 24 has a peripheral reduced diameter portion 31 forming a radial piston face 32 against which pump system hydraulic fluid pressure acts to bias the floating sleeve valve element away from the flange 22 and toward the hopper back wall 16. Hydraulic fluid is delivered to the exterior of sleeve portion 31 and piston face 32 through a radial port 33 in the crank arm 25, communicating with an axial port 34 in shaft 26. This latter port receives pump system pressurized hydraulic fluid under a regulated pressure in a conventional manner.

The floating sleeve valve element is preferably formed of steel and includes an easily replaceable liner 35 within its bore, the liner having an end flange 36, received in a stepped recess 37 at one end of the sleeve 24. The forward end face 38 of element 24 protrudes beyond the adjacent end face of the housing 23 and is received within an annular groove 39 of a steel wear ring 40. This interfitting relationship assures that the two elements 24 and 40 will swing as a unit with the housing 23 at proper times around the axis of crank shaft 26.

Pressurized hydraulic fluid acting on the piston face 32 is sealed on opposite sides of the delivery port 33 by pairs of ring seals 41 and 42 held in grooves on the two stepped peripheral portions of the sleeve 24. The projecting end face 38 of sleeve element 24 is sealed with the bottom of annular groove 39 by another ring seal 43. Because of the multiple seal arrangement on the floating sleeve element 24, pressurized hydraulic fluid from the port 33 cannot escape in either direction around the ends of the sleeve element.

As shown in FIG. 2, the bores of replaceable wear sleeve 35 and wear ring 40 are in registration and both of these bores register with the bore of transmission tube 18 at the flange 22 to form a smooth flow path for concrete being delivered to the transmission tube from either pump cylinder 12 or 11. The end face of wear ring 40 away from the housing 23 slidably contacts the opposing face of a steel wear plate assembly 44 which extends across the outlets of both cylinders 11 and 12 and is suitably attached to the hopper back wall 16. Preferably, the wear plate assembly includes two steel wear plate rings 44–45 which can be rotationally adjusted occasionally in the wear plate assembly to distribute and even-out wear. The rings 44–45 are of the same thickness. Both rings 44–45 abut the opposing end face 46 of wear ring 40.

This opposing end face of the wear ring 40 has an annular V-groove 47 formed therein to receive a preferably polyurethane ring 48 of like cross section. The wider base of the polyurethane ring or seal has wiping engagement with the steel wear plate assembly 44–45 when the crank arm 25, sleeve valve element 24 and wear ring 40 are swung from a position of registration with one pump cylinder to a position of registration with the other cylinder. At least while the receiving mouth of transmission tube 18 is aligned with each pump cylinder, the hydraulic pressure acting against the piston face 32 of sleeve valve element 24 maintains the wear ring 40 in the firm leak-proof abutment with the relatively stationary wear plate assembly 44–45.

Figure 5:
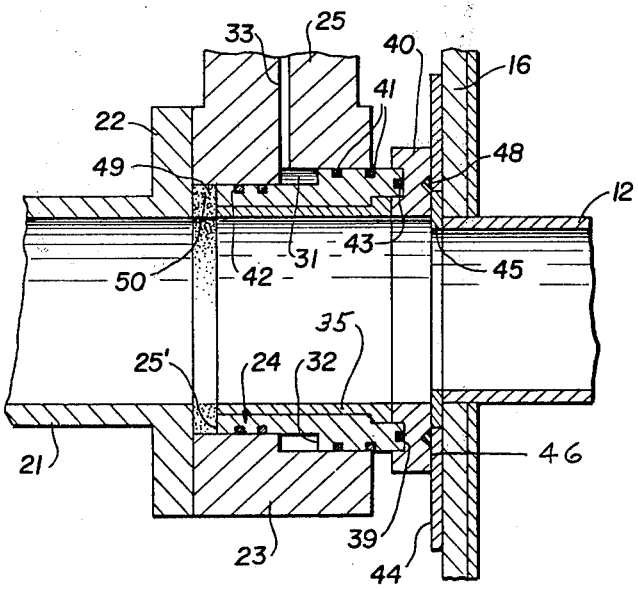
FIG. 5 is a fragmentary cross section, similar to FIG. 2, illustrating an automatic compensating feature of the invention as wearing of the wear ring and wear plate takes place to gradually diminish their thicknesses.

FIG. 5 shows the ability of the invention to compensate automatically for gradual wear on the plate assembly 44–45 and wear ring 40 resulting in reduced thicknesses of these parts. As this wear takes place, hydraulic fluid pressure on the piston face 32 continues to firmly hold the wear ring 40 against the opposing wear plate assembly whenever the conduit 18 is in registry with one of the cylinders of the pump as well as in a transition mode between the two cylinders. However, during transition, the hydraulic pressure is reduced somewhat by the pressure regulator for the system so that there will not be too much frictional drag between the opposing faces of the wear ring 40 and wear plate assembly to allow swinging movement of the crank arm 25.

As the described gradual wearing takes place, an annular gap 49, FIG. 5, will develop between the end face 25' of floating sleeve element 24 and the opposing flange 22. Pressurized cement grout 50 will enter and will fill up the gap 49 and exert fluid pressure on the end face 25' to supplement the hydraulic pressure on the piston face 32 particularly in the transition movement of the crank arm 25 where hydraulic pressure is reduced as previously noted. This feature constitutes an important aspect of the invention whereby the pressure of the flowable grout 50 may form a large or small component of the total fluid biasing pressure acting on the sleeve element 24 to force it against the wear ring 40 at all times. In any case, should the hydraulic pressure acting on the piston face 32 decrease to a level to cause leakage between the wear ring 40 and opposing wear plate assembly, the pressure of the grout 50 is still sufficient to maintain good sealing engagement between the wear ring and wear plate assembly. Furthermore, the wiping action of the polyurethane ring or packing 48 cleans the wear plate assembly and further reduces wear while preventing leakage of grout or any build-up of grout likely to impede the operation of the pump. Under normal operating conditions, approximately 50 psi of hydraulic fluid pressure from the port 33 acts on the piston face 32, and this pressure can be varied somewhat depending on the nature of the flowable being pumped and the materials from which the wear ring and wear plate assembly are made.

An inherent feature of the invention over the prior art is the fact that the sleeve element 24 is totally enclosed by the components 22, 23, 35 and 40 and therefore never comes into contact with concrete. In addition to supplementing pressure against the sleeve element 24, the grout 50 eventually hardens and forms a permanent spacer between the flange 22 and end face 25' thereby preventing reverse movement of the sleeve element 24 which would allow concrete to escape particularly where vertical pumping through conduit 18 takes place.

The system of seals 41, 42 and 43 not only holds the hydraulic fluid in a confined space behind the piston face 32 but also seals the concrete out.

The sleeve valve element 24 is designed so that the hydraulic pressure on piston face 32 supplies a greater force on the wear ring 40 than the force exerted by the concrete trying to escape. This insures a perfect seal as concrete is moving from a pump cylinder into and through the sleeve valve device. By means of the hydraulic system pressure regulator, when the concrete pressure moving through the sleeve valve increases, hydraulic pressure acting on the wear ring 40 automatically increases to maintain the necessary seal between the wear ring and wear plate assembly.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. In a pumping apparatus for concrete or the like including a hopper, a pair of alternating filling and pumping cylinder units connected in a wall of the hopper, a concrete transmission conduit connected in said hopper and having an elbow portion in the hopper, a crank means coupled with the elbow portion to swing it back and forth between positions of registration with the bores of said piston units, the improvement comprising a housing portion on the crank means having a stepped bore and having a hydraulic fluid port leading into the stepped bore, a stepped floating sleeve element engaged movably within the stepped bore and having an annular radial piston face within the larger portion of the stepped bore and being in communication with said port, a wear ring having interengaged relationship with one end of the floating sleeve element exteriorly of said housing portion, an opposing relatively stationary wear plate means fixed to said hopper and slidably abutting the wear ring and having opening means in registration with the bores of said cylinder units, there being an annular gap between the other end of the floating sleeve element and an end face of said elbow and receiving pressurized concrete which supplements the fluid pressure force of the hydraulic fluid on said piston face urging said floating sleeve element against the wear ring, and ring seals between the stepped surfaces of said floating sleeve element and said stepped bore on opposite sides of said port.

2. In a pumping apparatus as defined in claim 1, and a replaceable wear sleeve disposed within the bore of the floating sleeve element and serving with said wear ring, elbow end face and said stepped bore of the housing portion to substantially enclose and isolate the floating sleeve element.

3. In a pumping apparatus as defined in claim 1, and the wear ring having an annular groove in its end face opposing the wear plate means, and a wiping ring weal within said groove.

4. In a pumping apparatus as defined in claim 1, and said wear ring having an annular recess in its end face opposing the floating sleeve element, and the floating sleeve element having an annular end portion outside of said stepped bore engaging in said annular recess.

5. In a pumping apparatus as defined in claim 3, and a ring seal between the floor of said annular recess of the wear ring and said annular end portion of the floating sleeve element.

6. In a pumping apparatus for concrete or the like including a hopper for wet concrete, a pair of alternately discharging and filling pump cylinder units communicating with the hopper, a wet concrete transmission conduit leading from the hopper and having a swingable elbow within the hopper adapted for registration with the bore of each cylinder unit, power operated crank means connected with the elbow to swing it and including a housing portion disposed between an end face of the elbow and a wall of the hopper through which said cylinder units communicate with the hopper, the improvement comprising a floating piston sleeve element movably mounted within the housing portion and having one end face projecting outside of the housing portion, the housing portion having a hydraulic fluid port delivering pressurized hydraulic fluid to an actuating surface of said floating piston sleeve element, a wear ring of gradually diminishing thickness outside of the housing portion and between the latter and said wall of the hopper, the wear ring having interlocked relationship with that portion of the floating piston sleeve element projecting outside of the housing portion, an opposing wear plate fixed on said wall of the hopper in sliding engagement with the wear ring, and there being a gradually widening gap between the other end of the piston sleeve element and said elbow end face, said gap receiving pressurized concrete which fills the gap and supplements the fluid pressure force of hydraulic fluid against said actuating surface to continually urge the floating piston sleeve element toward the wear ring.

7. In a pumping apparatus for concrete as defined in claim 6, and ring seals on the exterior of the floating piston sleeve element within the housing portion and on opposite sides of said port.

8. In a pumping apparatus for concrete as defined in claim 7, and another ring seal on the end face of the floating piston sleeve element which is interlocked with said wear ring.

9. In a pumping apparatus for concrete as defined in claim 8, and a replaceable liner disposed within the bore of the floating piston sleeve element.

* * * * *